United States Patent [19]

Rhoad

[11] 3,961,925

[45] June 8, 1976

[54] REFRIGERATED STORAGE AND TRANSPORTATION CONTAINER FOR PERISHABLE COMMODITIES

[76] Inventor: John H. Rhoad, P.O. Box 108, Lapush, Wash. 98350

[22] Filed: Dec. 16, 1974

[21] Appl. No.: 532,833

[52] U.S. Cl. ..... 62/376; 62/239; 62/435; 62/457; 134/123

[51] Int. Cl.[2] ..... F25D 17/02

[58] Field of Search ..... 62/375, 376, 374, 63, 62/64, 62, 430, 435, 457, 239, 371; 134/123

[56] References Cited

UNITED STATES PATENTS

| | | | |
|---|---|---|---|
| 2,080,103 | 5/1937 | Zarotschenzeff | 62/375 X |
| 2,153,742 | 4/1939 | Conn | 62/374 |
| 2,324,517 | 7/1943 | King | 62/375 X |
| 2,337,323 | 12/1943 | Gates | 62/376 |
| 2,740,378 | 4/1956 | Duncan | 62/376 X |
| 2,982,109 | 5/1961 | Puretic | 62/376 X |
| 3,698,029 | 10/1972 | Pullium | 134/123 X |

*Primary Examiner*—William F. O'Dea
*Assistant Examiner*—Ronald C. Capossela
*Attorney, Agent, or Firm*—Graybeal, Barnard, Uhlir & Hughes

[57] ABSTRACT

A portable, self-contained, refrigerated storage and transportation container for preserving perishable commodities includes an insulated storage chamber for the perishable commodities. A recirculating liquid cooling system is provided within the container and includes conduit and nozzle means disposed within the storage chamber adapted to spray a liquid coolant, such as chilled brine, directly onto the perishable commodities to maintain them at a uniform cool temperature. The sprayed liquid coolant is collected in the bottom portion of the storage chamber. A closed refrigeration system is also provided within the container and includes, in part, heat exchange means disposed within the bottom portion of the storage chamber for cooling the sprayed liquid coolant which has collected there.

14 Claims, 9 Drawing Figures

10
52
20
18
35
33
35

REFRIGERATED STORAGE AND TRANSPORTATION CONTAINER FOR PERISHABLE COMMODITIES

BACKGROUND OF THE INVENTION

1. Field of the Invention

This invention relates, in general, to refrigeration apparatus for storing and transporting perishable commodities, and more particularly to portable, self-contained, refrigerated storage and transportation containers. Specifically, the invention relates to a refrigerated storage and transportation container having a closed liquid cooling system wherein the perishable commodities are bathed in the coolant to maintain them at a uniform cool temperature.

2. Description of the Prior Art

The use of individual, self-contained refrigerated containers for transporting fresh and frozen perishable commodities, such as meat, fish, poultry and produce, is well-known, and a variety of refrigeration systems and containers have been devised. One such system employs a closed refrigeration circuit in which a liquid refrigerant is circulated through coils or the like, and air is then blown across the cold coils. The cooled air is subsequently circulated throughout a container wherein the perishable commodities are stored. Examples of such systems are disclosed in U.S. Pat. Nos. 2,984,084, 3,175,606, 3,359,752, 3,699,870 and 3,733,849. One drawback of this type system is that a uniform cool temperature throughout the container is generally not obtained. This is caused by non-uniform circulation of the cool air through the container due to the presence of the commodities therein. Another drawback of this type system is that the refrigeration "cool down" capability of the container is relatively slow.

Another type of system for preserving perishable commodities while in transit utilizes cryogenic materials, such as liquid nitrogen, as the cooling source. Generally, the cryogen is stored as a liquid and then fed into the container wherein the perishable commodities are stored. Upon entry of the cryogen into the container, the liquid converts to a gas, and this gas is then circulated throughout the container. Examples of such systems are dsclosed in U.S. Pat. Nos. 3,421,336, 3,446,028 and 3,557,559. One problem with such systems is that the gas temperature frequently varies in different areas of the container, even if the same quantity of cryogen is introduced per unit length of the container. This may result in the thawing and re-freezing of delicate perishable commodities causing damage and loss. Finally, some cryogenic gases when improperly proportioned with oxygen have a deleterious effect on many kinds of fresh produce.

Yet another system utilized for storing and transporting perishable commodities incorporates both of the above-described systems. In such a system, a cryogen source cools incoming air which circulates throughout the storage container. In addition, at various interludes the cryogenic gas is leaked directly into the storage container. Such a system is disclosed in U.S. Pat. No. 3,385,073. While this system does overcome some of the above-noted problems, not all of them have been solved, and consequently spoilage of a certain portion of the perishable commodities is routine and expected during long transit and/or storage.

The present invention differs from the above-described systems in that the cooling source is a liquid and remains a liquid throughout the entire cooling process. Furthermore, this liquid coolant is sprayed directly onto the perishable commodities to maintain them at a uniform cool temperature, and the liquid coolant is itself cooled within the same chamber which contains the perishable commodities.

SUMMARY OF THE INVENTION

It is, therefore, one object of the present invention to provide a system for storing and transporting perishable commodities.

Another object of the present invention is to provide a self-contained, refrigerated storage and transportation container for preserving perishable commodities.

A further object of the present invention is to provide a container for transporting and storing perishable commodities wherein the commodities are continually bathed in a liquid coolant to maintain them at a uniform low temperature.

An additional object of the invention is to provide a self-contained, refrigerated storage and transportation container for preserving perishable commodities, and specifically fresh fish, wherein the container includes a recirculating brine cooling system such that the fish remain in direct contact with the chilled brine thereby minimizing spoilage.

To achieve the above and other objects and in accordance with the invention, an insulated, hermetic storage chamber for accommodating perishable commodities is provided within a portable container. To maintain the perishable commodities at a uniform low temperature to prevent spoilage thereof, the container includes a closed, recirculating liquid cooling system for cooling the perishable commodities, and a closed refrigeration system for cooling the liquid coolant. Preferably, the liquid coolant is either chilled water or brine, depending upon the type of commodities being transported or stored. The liquid cooling system includes pump means for delivering the liquid coolant to a plurality of conduit tubes located within the storage chamber. Disposed along the lengths of the conduit tubes are a plurality of nozzle means which spray the liquid coolant directly onto the perishable commodities thus bathing them in the liquid coolant. The sprayed liquid coolant subsequently collects in the bottom portion of the storage chamber, and recirculating means, preferably a suction duct, are provided for withdrawing the sprayed liquid coolant therefrom and returning it to the pump means.

To maintain the liquid coolant at the required low temperature, the refrigeration system includes heat exchanger means located in the bottom portion of the storage chamber and which preferably comprises a plurality of conduit tubes interconnected to form a single flow path for a liquid refrigerant such as freon. A compressor and condenser of conventional design cools the refrigerant and delivers it to the refrigerant conduit tubes, return means also being provided for directing the circulated refrigerant from the conduit tubes back to the compresser and condenser. In this manner, the sprayed liquid coolant collects in the bottom portion of the storage chamber and is cooled by contact with the refrigerant conduit tubes, the refrigerant being maintained at a temperature substantially lower than that of the liquid coolant. Having been cooled, the liquid coolant is recirculated back through the pump means to the conduit and nozzle means to be sprayed once again onto the perishable commodities. In preferred form, a temperature sensing element is located within the liquid coolant system for measuring the temperature of the coolant, and feedback means are provided for shutting off the refrigerant compressor if the temperature of the liquid coolant falls below a certain predetermined level.

The storage chamber preferably contains a multi-level support structure upon which open-topped, perforated receptacles containing the perishable commodities are stored. The nozzle means disposed along the liquid coolant conduit tubes are located immediately above the receptacles at each level such that the liquid coolant is sprayed into the receptacles. The perishable commodities are thus bathed by the liquid coolant within the receptacles and are thereby maintained at a uniform cool temperature. Hence, the problem of liquid coolant circulation within the container is avoided since the commodities come into direct contact with the liquid coolant throughout the entire storage chamber, yet the problem of freeze damage to the commodities due to direct contact with a cooling substance such as nitrogen is prevented since the liquid coolant is not of a cryogenic or gaseous nature, and its temperature can be readily regulated.

Figures 1, 2, 5, 7, 8:
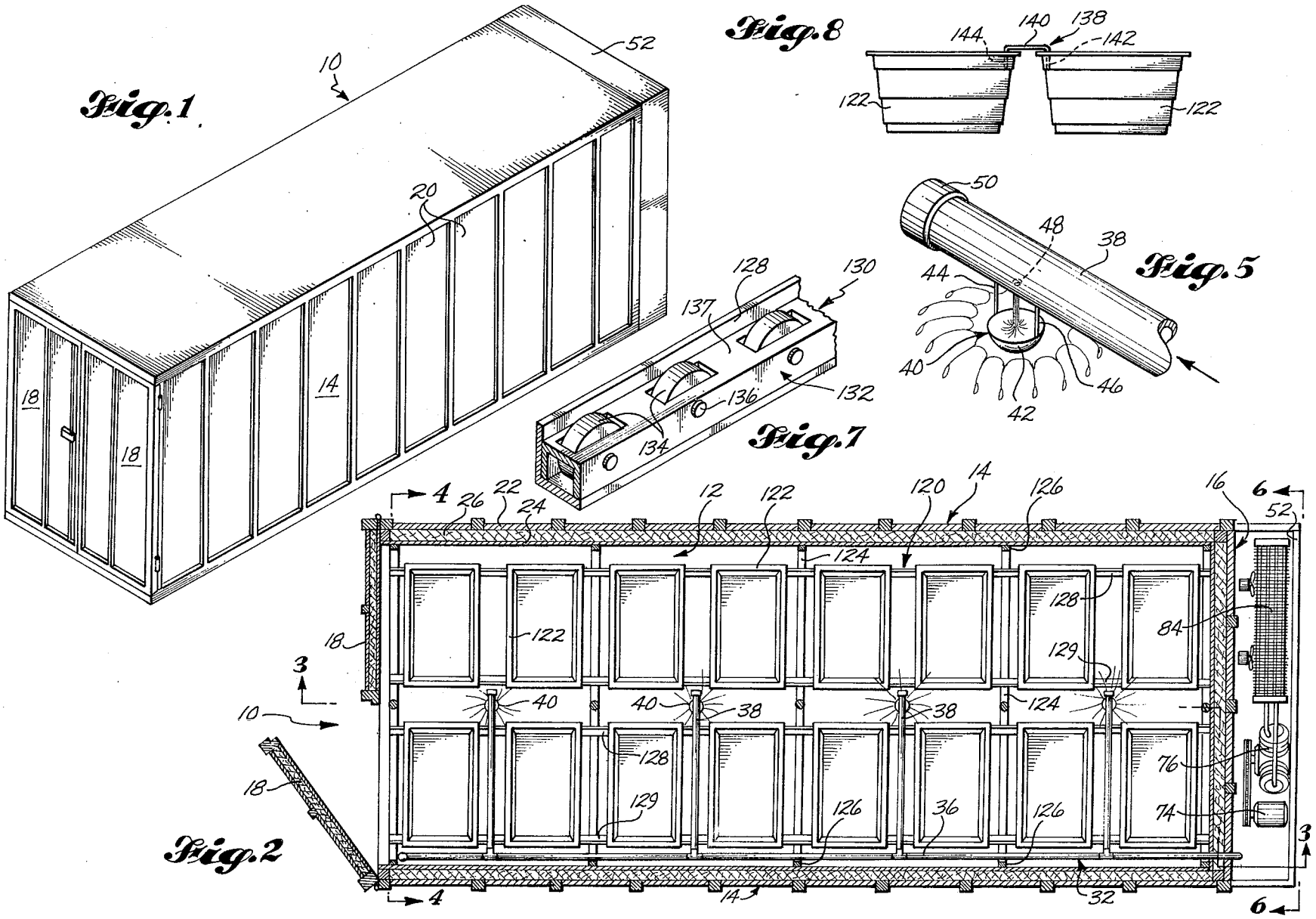
FIG. 1 is a reduced perspective view of a typical container according to the present invention.
FIG. 2 is a top plan view of the interior of a typical container of the present invention.
FIG. 5 is a perspective, partially fragmented view of a spray tube and nozzle means utilized in a typical embodiment of the present invention.
FIG. 7 is an enlarged fragmented perspective view of a longitudinal support beam with conveying means utilized in the support structure within the storage chamber of the typical illustrated embodiment of the present invention.
FIG. 8 is a side elevation view of two interconnected receptacles utilized in a typical embodiment of the present invention.

DETAILED DESCRIPTION OF THE INVENTION polyurethane.

Referring to FIGS.. 1 – 4, a portable, self-contained, refrigerated container 10 has a storage chamber 12 defined therewithin. To ensure proper insulation of chamber 12, the side walls 14, front wall 16 and doors 18 are all constructed from a plurality of panels 20 having thin inner and outer metal or plastic surfaces 22, 24 which sandwich any appropriate insulating material 26, such as polyurethane. In addition, the top and bottom of storage chamber 12 are similarly constructed to provide both proper insulation and an essentially hermetic enclosure.

Disposed within container 10 is a closed, recirculating liquid coolant system designated generally at 28, and a closed refrigeration system designated generally at 30. The liquid coolant system 28 is adapted to spray a liquid coolant within the storage chamber 12 directly onto the perishable commodities contained therein. The liquid collant is preferably chilled water or brine, although the choice and temperature of the coolant will depend upon the type of commodities being carried within storage chamber 12. The coolant, however, must remain liquid in form throughout its entire circulation path. By way of example, a brine coolant is preferred when the perishable commodities consist of fresh fish.

Figure 9:
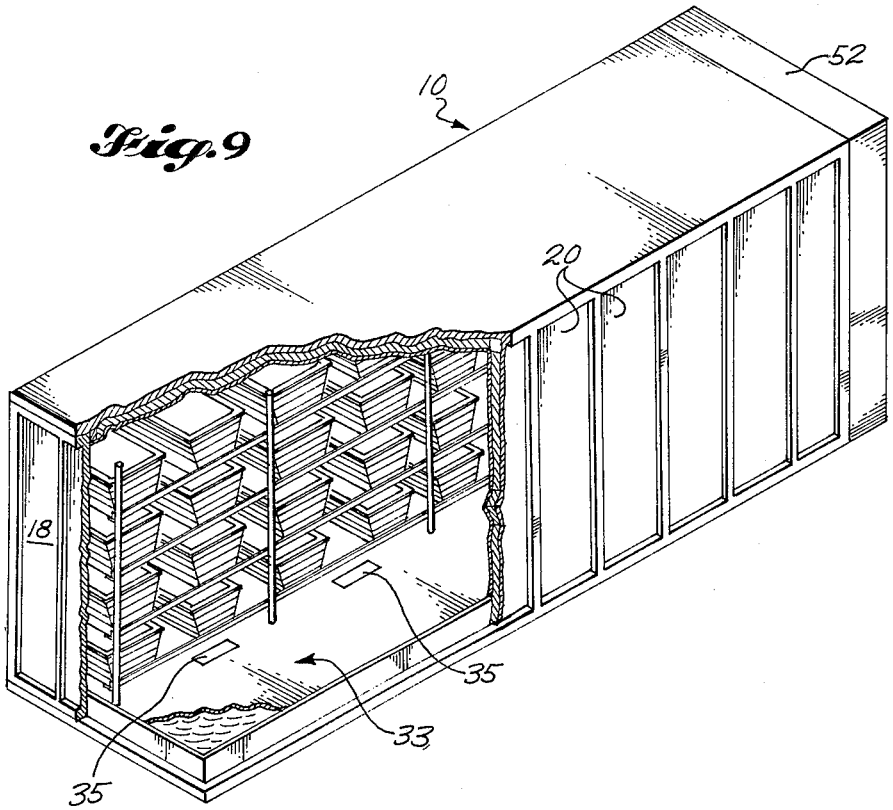
FIg. 9 is a perspective, partially fragmented view of a typical container made according to the present invention including a cover over the coolant collection tank having one-way valve means included therein.

After the liquid coolant has been sprayed onto the perishable commodities, it collects in the bottom portion of the storage chamber 12, the bottom portion being adapted as a collection tank 31. The refrigeration system 30, adapted to cool the liquid coolant, preferably cools it within collection tank 31 wherein the liquid coolant has collected. After having been cooled in tank 31, the coolant is recirculated back through the system. It should be noted that the collection tank 31 may also include a cover 33 (FIG. 9) which contains one or more one-way valves 35 such that the sprayed liquid coolant can enter tank 31 through the valves but may not exit therethrough. This is especially preferred if container 10 is to be transported across mountainous terrain, for the cover would limit the movement of the sprayed liquid coolant within tank 31 and container 10.

In greater detail, the liquid coolant system 28 includes a conduit delivery means 32 disposed within the storage chamber 12. In the illustrated form, means 32 includes a main coolant manifold 34, preferably 1.5 inches in diameter, which extends vertically within chamber 12 proximate to the doors 18. Connected to manifold 34 and extending substantially the length of chamber 12 are a plurality of horizontal delivery tubes 36, preferably 1.5 inches in diameter. Connected to each delivery tube 36 and extending toward the center line of chamber 12 are a plurality of horizontal spray tubes 38, preferably 1 inch in diameter. In the illustrated embodiment, the delivery tubes 36 extend along the inside of one side wall 14 spaced apart from and parallel to one another, with spray tubes 38 extending in a substantially perpendicular manner from each delivery tube 36 to the center line of chamber 12. In this manner, a plurality of vertical levels are defined by the conduit means 32, as discussed in greater detail below. In addition, the uppermost delivery tube 36 extends through the front wall 16 of chamber 12 for connection to a pump means, as described in greater detail below. All the remaining tubes 36 and 38 are capped at their ends.

Disposed at each end of each spray tube 38 proximate to the longitudinal center line of chamber 12 is a nozzle device 40. Each nozzle 40 is adapted to spray the liquid coolant outwardly and downwardly therefrom, thus spraying the liquid coolant directly onto the perishable commodities stored in the area immediately therebelow. As shown in FIG. 5, a preferred form of the nozzle device 30 comprises a cup member 42 suspended below spray tube 38 by a pair of hanger rods 44, 46. Perforation 48 is located in the wall of tube 38 immediately above cup member 42, tube 38 being closed at its end by cap 50. With this arrangement, liquid coolant delivered to spray tube 38 is formed through perforation 48 into cup member 42 such that the liquid coolant, upon striking cup member 42, is dispersed in small droplets outwardly therefrom and down onto the perishable commodities. It should be understood that other types of nozzle configurations may also be utilized in the present invention for spraying the liquid coolant onto the perishable commodities.

Referring to FIGS. 1–4 and FIG. 6, container 10 includes a housing unit 52 integral therewith and disposed adjacent to the forward wall 16 of chamber 12. Unit 52 houses the pump means, compressor unit, condenser unit and power source for the liquid coolant system 28 and refrigeration system 30. However, it should be noted that alternatively these items may be located within chamber 12 so as to eliminate the necessity of unit 52. Located within housing unit 52 is a pump means 54 adapted to deliver the liquid coolant to the conduit delivery means 32. In preferred form, pump means 54 includes a pump motor 56 adapted to drive a liquid pump 58. A pipe 60 delivers the pumped liquid coolant from pump 58 to the delivery tube 36 which passes through front wall 16. Also connected to pump 58 is a liquid coolant strainer 62 with a suction duct 64 extending therefrom through the front wall 16 into collection tank 31 of storage chamber 12. Therefore, as pump 58 delivers the liquid coolant to the conduit delivery means 32, it also withdraws the sprayed liquid coolant 65 from collection tank 31 by way of suction duct 64. Thus, a closed, recirculating liquid cooling system is provided wherein the liquid coolant utilized to preserve the perishable commodities within the storage chamber 12 may be used repeatedly.

To maintain the liquid coolant at a temperature sufficiently low to effectively preserve the perishable commodities, the refrigeration system 30 includes heat exchanger means 66 disposed in the collection tank 31. In the illustrated form, means 66 comprises a plurality of spaced-apart, tubular coils 68 which are interconnected to define a single flow path through which the refrigerant circulates, the refrigerant being any suitable liquid refrigerant material known to the art, such as Freon. In preferred form, the coils extend substantially the length of the storage chamber 12 in several vertical layers so that as the sprayed liquid coolant 65 collects in tank 31, it contacts and circulates between the coils 68. The refrigerant circulating through coils 68 is maintained at a temperature substantially lower than that of the liquid coolant so that heat is extracted by the refrigerant from coolant 65 upon contact with coils 68, thereby cooling the liquid coolant.

Figure 6:
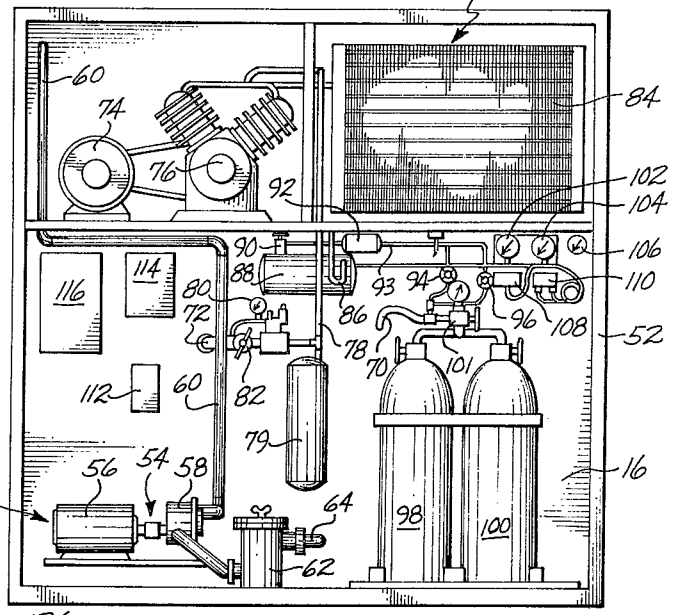
FIG. 6 is an enlarged cross-sectional view taken substantially along line 6—6 of FIG. 2.
Figure 3:
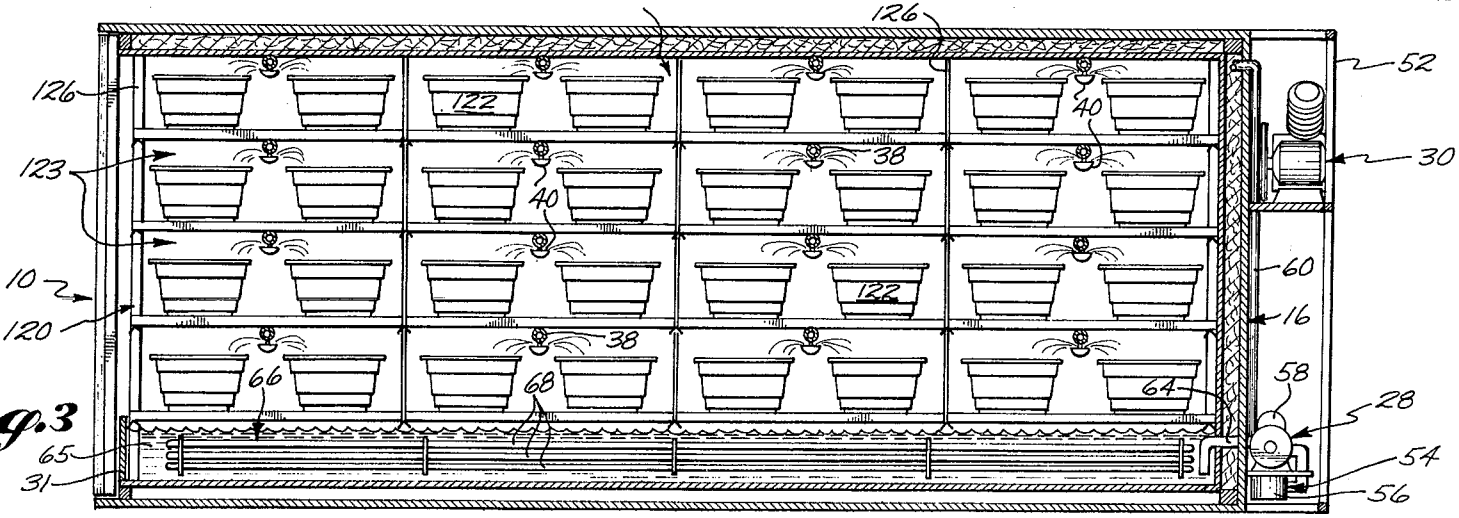
FIG. 3 is a cross-sectional view taken substantially along line 3—3 of FIG. 2.
Figure 4:
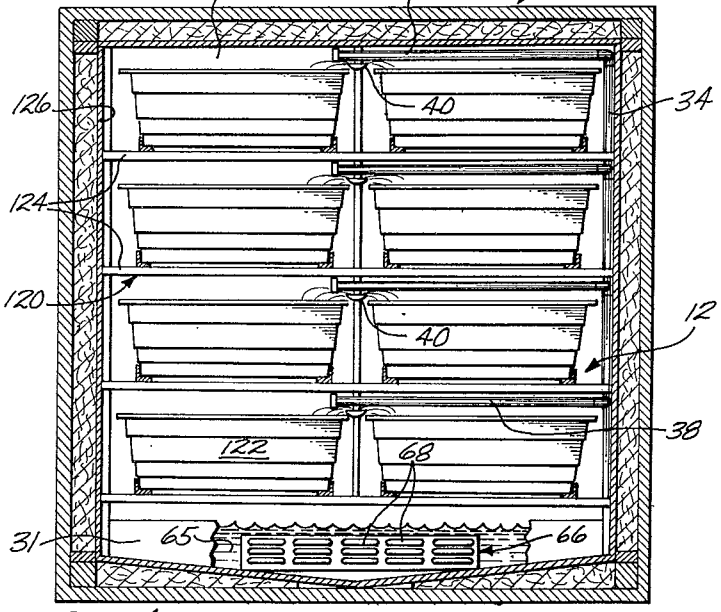
FIG. 4 is an enlarged cross-sectional view taken substantially along line 4—4 of FIG. 2.

Referring to FIG. 6, means for cooling, condensing and delivering the liquid refrigerant to refrigerant coils 68 are disposed within housing unit 52. Delivery tubing 70, which passes through front wall 16, delivers the cooled refrigerant to coils 68, while return tubing 72, which connects the refrigerant coils 68 to the refrigerant cooling means, returns the warmed, gaseous refrigerant thereto. In the illustrated form, electric motor 74 drives a compressor 76 which receives the warmed, gaseous refrigerant from line 78. The refrigerant flow from return tubing 72 to compressor 76 is controlled and monitored by suction accumulator 79, an evaporator pressure regulator valve 80 and a king valve 82. Upon compression of the gaseous refrigerant by compressor 76, the refrigerant is then directed to a condenser 84 wherein the refrigerant is cooled. The cooled refrigerant then passes through tube 86 into a liquid receiver 88. A charging valve 90 enables charging of the refrigeration system 30 with new refrigerant in case of leakage or if replacement becomes necessary. From receiver 88, the refrigerant passes through a filter/dryer 92, through line 93 and then to the delivery tube 70. A hand expansion valve 94 and a thermostatic expansion valve 96 are operatively connected to line 93 for controlling the flow of refrigerant between receiver 88 and the delivery tube 70. Various gaseous and/or liquid additives for purging the refrigeration system 30 or the storage chamber 12 may be stored in tanks 98 and 100 and introduced into the system by way of valve 101. Additional monitoring and controlling the flow of refrigerant is performed by a compound gage 102, a high pressure gage 104, a temperature gage 106, high pressure control switch 108 and dual control switch 110.

Additionally located within housing unit 52 is a magnetic starter control 112 for pump 56, a magnetic starter control 114 for compressor motor 74, and and electrical entrance panel 116 for both the liquid coolant system 28 and the refrigeration system 30. It should be noted, however, that pump motor 56 for coolant system 28 and compressor motor 74 for refrigeration system 30 may comprise any conventional type motor device such as electric, gasoline or diesel powered motors.

Interposed in line 60 is a temperature sensing element (not illustrated) adapted to measure the temperature of the liquid coolant. A thermostat feedback mechanism (not illustrated) of conventional design is provided between such sensing element and the compressor motor 74 so that if the temperature of the liquid coolant falls below a certain predetermined level, the compressor motor 74 is shut off, and once the coolant temperature increases to the predetermined level, the compressor motor 74 is again activated to keep the temperature of the coolant from increasing significantly beyond such predetermined level. In this manner, the temperature of the coolant may be closely regulated and maintained within a narrow range. Furthermore, intermittent spraying of the liquid coolant may also be utilized to regulate the temperature of the coolant and consequently the temperature of the perishable commodities. By way of example, when fresh fish is the commodity being transported and chilled brine is utilized as the liquid coolant, the preferred predetermined temperature level of the brine is just above its freezing level, or about 28 degrees F. Thus, the fish will be maintained at a temperature as low as possible without freezing either the fish or the brine coolant due to the sensing element/feedback mechanism design. However, the temperature of the brine coolant may vary above 28 degrees F. depending on the type of commodity being transported.

Referring again to FIGS. 2 – 4, the perishable commodities may be stored within the storage chamber 12 in any manner as long as the liquid coolant being sprayed from nozzles 40 comes into direct contact therewith. In the illustrated form, a support structure 120 is provided for the perishable commodities. The commodities are preferably stored within opentopped receptacles 122 which are carried by the support structure 120 and which have perforations (not illustrated) in their bottoms so that the sprayed liquid coolant may drain therethrough and into collection tank 31. The support structure 120 is preferably divided into a number of vertical levels 123, each level being associated with a horizontal delivery tube 36 and its spray tubes 38. In this manner, the receptacles 122 carrying the perishable commodities are positioned at each level 123 immediately below a spray tube 38 and nozzle 40. Each vertical level 123 of the support structure 120 includes a plurality of horizontal cross bars 124 extending substantially the width of chamber 12. The cross bars 124 of each level 123 are substantially parallel with each other and vertically aligned with the cross bars 124 of the other support structure levels 123.

The ends of the cross bars 124 may be secured to the side walls 14 of chamber 12 or, as illustrated herein, to a plurality of vertical braces 126, each vertical brace interconnecting similar ends of vertically aligned cross bars 124. At each level 123, a plurality of horizontal, paired longitudinal support beams 128, 129 extend substantially the length of storage chamber 12 and are secured to cross bars 124. Each pair of longitudinal support beams 128, 129 is adapted to carry a longitudinal row of receptacles 122 immediately beneath nozzles 40. In this manner, each vertical level of receptacles 122 is exposed to a plurality of nozzles 40 so that the perishable commodities carried within receptacles 122 are continually bathed by liquid coolant. In the illustrated form, there are two pairs of longitudinal support beams 128, 129 which carry two longitudinal rows of receptacles 122. However, the present invention may be adapted to carry any number of rows of receptacles 122, depending on the size and type of perishable commodities and the overall size of container 10.

Referring to FIG. 7, each longitudinal support beam 128 and 129 includes a conveying means 130 adapted to afford convenient insertion and removal of receptacles 122 into and from the storage chamber 12. In the illustrated form, a longitudinal housing 132 is provided along the entire length of beam 128. A plurality of rollers 134 are pivotally secured within housing 132 by pins 136, the rollers 134 extending slightly above the upper surface 137 of housing 132. By this arrangement, the bottom portions of receptacles 122 make rolling contact with rollers 134 enabling them to be easily moved along the length of the paired beams 128, 129.

While receptacles 122 may be simply carried on beams 128, 129 it may be desirable to adapt receptacles 122 to prevent unintentional movement along the beams 128, 129 during transportation of container 10. as illustrated in FIG. 8, one means of preventing such movement is to interconnect receptacles 122 in such a manner so as not to interfere with the spraying of the liquid coolant into the receptacles. To achieve this, a bracket 138 is provided having a base 140 and two depending arm portions 142 and 144. Each depending arm portion 142, 144 is inserted into one side of adjacent receptacles 122 such that base 140 bridges the gap therebetween. Preferably, depending arm portions 142, 144 are angled inwardly toward each other thus enabling them to exert a force outwardly against the sides of receptacles 122 when in position. It should be noted, however, that any means of interconnecting receptacles 122 or securing them along beams 128, 129 for transportation may be utilized with the present invention.

As can be seen from the above, a completely selfcontained, refrigerated storage and transportation container is provided for preserving perishable commodities. The temperature of the commodities may be mainted within a very narrow range inasmuch as they come into direct contact with the liquid coolant, yet such contact does not damage the commodities. Spoilage of the perishable commodities is maintained at a minimum, yet the simplicity of the device allows for easy maintenance and fewer mechanical failures which can result in complete spoilage of the entire cargo. Furthermore, if fresh produce or fish is being transported, use of a brine or water coolant with the present invention will not only maintain the products at a desired constant low temperature, but will also prevent drying out of the products.

It will be understood that the invention may be embodied in other specific forms without departing from the spirit and central characteristics thereof. The present illustrations and embodiments, therefore, are to be considered in all respects as illustrative and not restrictive, and the invention is not to be limited to details given herein but may be modified within the scope of the appended claims.

I claim:

1. A self-contained, refrigerated storage and transportation container for preserving perishable commodities comprising:

a container defining an insulated storage chamber therewithin for accommodating said perishable commodities;

a recirculating liquid cooling system comprising conduit means for a liquid coolant disposed within said storage chamber, nozzle means disposed along said liquid coolant conduit means and adapted to spray said liquid coolant directly onto said perishable commodities to maintain said commodities at a uniform cool temperature, means within said container for delivering said liquid coolant to said liquid coolant conduit means, and recirculating means within said container adapted to withdraw the sprayed liquid coolant from the bottom portion of said storage chamber and recirculate it back through said liquid cooling system;

the bottom portion of said storage chamber comprising a collection tank having a cover thereover to reduce movement of said liquid coolant in said collection tank during transport of said container, said cover including one-way valve means allowing coolant to flow into but not out of said collection tank during transport of said container; and refrigeration means within said container adapted to cool said liquid coolant, said refrigeration means comprising heat exchanger means for a circulating refrigerant disposed within said collection tank and adapted to contact said collected liquid coolant, means for cooling said refrigerant and delivering it to said heat exchanger means, and refrigerant return means adapted to receive said circulated refrigerant from said heat exchanger means and return it to said refrigerant cooling means.

2. The container according to claim 1, wherein said means for delivering said liquid coolant to said liquid coolant conduit means and said means for cooling said refrigerant and delivering it to said heat exchanger means are disposed exterior to said storage chamber.

3. The container according to claim 1, wherein said liquid coolant conduit means comprises a plurality of delivery tubes extending substantially the length of said storage chamber, and a plurality of spray tubes interconnected with said delivery tubes, each said spray tube having at least one said nozzle means disposed along its length.

4. The container according to claim 1, wherein said liquid coolant is substantially water.

5. The container according to claim 4, wherein said liquid coolant is brine.

6. The container according to claim 1, wherein said heat exchanger means comprises a plurality of spaced apart tubular coils interconnected to define a single flow path through which said refrigerant circulates, said sprayed liquid coolant being collected in said collecting tank to contact said coils and fill the spaces therebetween, said refrigerant being maintained at a temperature lower than that of said sprayed liquid coolant so as to cool said coolant upon contact with said coils.

7. A portable self-contained, refrigerated storage and transportation container for preserving perishable commodities comprising:

a container defining an insulated, hermetic storage chamber therewithin for accommodating said perishable commodities, the bottom portion of said chamber being adapted as a collection tank, and including a splash reducing cover with one-way valve means disposed, therein to allow brine to flow into but not out of said chamber during transport of the container;

a recirculating brine cooling system integral with said container and comprising conduit means for a brine coolant disposed within said storage chamber, nozzle means disposed along said brine conduit means and adapted to spray said brine directly onto said perishable commodities to maintain said commodities at a uniform cool temperature without freezing said commodities, the sprayed brine collecting in said collection tank, pump means for delivering said brine to said brine conduit means, and recirculating means interconnecting said pump means with said collection tank and adapted to withdraw said sprayed brine and return it to said pump means; and refrigeration means integral with said container and adapted to cool said brine, said refrigeration means comprising conduit means for a refrigerant disposed within said collection tank and adapted to contact and cool said sprayed brine, means for cooling said refrigerant and delivering it to said refrigerant conduit means, and refrigerant return means adapted to receive said circulated refrigerant from said refrigerant conduit means and return it to said refrigerant cooling means.

8. The container according to claim 7, wherein said brine conduit means comprises a plurality of delivery tubes extending substantially the length of said storage chamber, and a plurality of spray tubes interconnected with said delivery tubes and extending to the longitudinal center line of said storage chamber, each said spray tube having one said nozzle means disposed along its length proximate to the longitudinal center line of said chamber.

9. The container according to claim 7, wherein said recirculating means comprises a suction duct disposed in said collection tank and interconnected to said pump means, said suction duct withdrawing the cooled brine from said collection tank and directing said brine to said pump means.

10. The container according to claim 7, wherein said refrigerant conduit means comprises a plurality of spaced apart tubular coils interconnected to define a single flow path through which said refrigerant circulates, said sprayed brine contacting said coils and filling the spaces therebetween, said refrigerant being maintained at a temperature lower than that of said sprayed brine so as to cool said brine upon contact with said coils.

11. The container according to claim 7, wherein said storage chamber includes therein a multi-level support structure for carrying said commodities, each vertical level of said support structure comprising a plurality of horizontal cross bars extending substantially the width of said chamber and a plurality of horizontal, paired longitudinal support beams secured to said cross bars and extending substantially the length of said storage chamber, each pair of support beams being adapted to carry a longitudinal row or said commodities.

12. The container according to claim 11, wherein each said support beam includes conveying means adapted to afford convenient insertion and removal of said commodities into sand from said storage chamber.

13. The container according to claim 11, wherein said brine conduit means comprises a plurality of delivery tubes with each said delivery tube extending substantially the length of said storage chamber adjacent one of said support structure levels, and a plurality of spray tubes connected to each said delivery tube and extending therefrom toward the longitudinal center line of said storage chamber immediately above the commodities carried by the adjacent support structure level.

14. A portable, self-contained, refrigerated storage and transportation container for preserving perishable commodities without freezing comprising:

an insulated, hermetic storage chamber within said container for accommodating perishable commodities, brine conduit means within said storage chamber including nozzle means disposed therealong and adapted to spray brine directly onto said perishable commodities;

a brine collection tank positioned below said storage chamber and including a cover thereover, said cover including one-way valve means adapted to allow said brine to flow downwardly into said collection tank and be retained thereby during transport of the container, heat exchanger means for circulating refrigerant disposed within said collection tank; and a housing unit positioned laterally adjacent said storage chamber and said collection tank, said housing unit including pump and associated conduit means for drawing cooled brine from said collection tank and delivering it to said conduit means in said storage container; and, pump and associated tubing means for drawing refrigerant from said heat exchanger means, cooling it and delivering the cooled refrigerant to said heat exchanger means.

* * * * *